United States Patent [19]

Barber

[11] 3,949,679

[45] Apr. 13, 1976

[54] AMUSEMENT RIDE

[75] Inventor: Gerald L. Barber, Greenville, S.C.

[73] Assignee: Venture Ride Mfg., Inc., Greer, S.C.

[22] Filed: Oct. 4, 1974

[21] Appl. No.: 512,105

[52] U.S. Cl. ..... 104/63; 104/84; 104/89; 104/93; 272/29; 272/34; 272/40; 272/43

[51] Int. Cl.[2] ..... A63G 1/24; A63G 1/34

[58] Field of Search ..... 104/53, 63, 64, 67, 84, 104/89, 91, 93, 106, 110; 272/24, 28 R, 29, 34, 39, 40, 43, 44, 45; 191/4

[56] References Cited

UNITED STATES PATENTS

| | | | |
|---|---|---|---|
| 1,127,753 | 2/1915 | Glynn | 104/63 |
| 1,890,137 | 12/1932 | Traver | 104/63 |
| 3,484,104 | 12/1969 | Goforth et al. | 272/29 |
| 3,625,158 | 12/1971 | Lorenz et al. | 104/93 |
| 3,637,956 | 1/1972 | Blackman | 191/4 |
| 3,854,419 | 12/1974 | Cocroft | 104/93 X |
| 3,858,520 | 1/1975 | Patin | 104/89 |

*Primary Examiner*—Albert J. Makay
*Assistant Examiner*—Randolph A. Reese
*Attorney, Agent, or Firm*—Melvin A. Crosby

[57] ABSTRACT

An amusement ride, especially a trailer mounted amusement ride, in which passenger cabs, or compartments, are suspended from a track which has one reach extending longitudinally along the trailer on the outside and another reach inside the trailer following a sinuous path therethrough. The track portion outside the trailer is detachable therefrom for transporting the ride from place to place. The trailer vehicle is also adapted for being coupled to another trailer vehicle in end to end relation to form an elongated ride. The passenger cabs, or compartments, have individual drive motors thereon for propelling the cabs along the track and each motor is battery powered by a battery on the respective cab. Conveniently, battery charging rails are provided inside the trailer so that the batteries are charged while the cabs are moving inside the trailer and the cabs run solely on battery power while outside the trailer.

9 Claims, 7 Drawing Figures

AMUSEMENT RIDE

The present invention relates to an amusement ride, especially a dark ride, and most particularly to a ride of the nature referred to which is trailer mounted for easy transport.

Dark rides and the like for amusement purposes are known and are generally stationary. The ride of the present invention is unique in that it is trailer mounted for ready movement from place to place as is required when the ride is employed in travelling carnivals or in connection with amusement installations which are temporarily set up in shopping centers and the like.

A primary object of the present invention is the provision of a ride of the nature referred to which can be prepared for transport quickly and simply and which can also be set up quickly, and in a rather simple manner, when the ride reaches a place of use.

Another object of the present invention is the provision of a ride of the nature referred to having a novel arrangement for individually powering the passenger cabs, or compartments, forming a part of the ride.

It is also an object of the present invention to provide a trailer mounted amusement ride, especially a dark ride, in which two like trailers can be connected in end to end relation to provide for an elongated ride.

BRIEF SUMMARY OF THE INVENTION

According to the present invention, a trailer vehicle is provided adapted for connection to a tractor for movement of the vehicle from place to place. The vehicle has associated therewith an endless track having one reach extending longitudinally along the trailer on the outside and another reach extending longitudinally of the trailer on the inside and following a sinuous path. The inside of the trailer has partition members disposed adjacent the convolutions of the reach of the track which is inside the trailer which effectively divides the trailer into compartments in which visual and sound effect equipment can be placed.

The two reaches of the track are connected by end sections so that a cab can be propelled along the entire length of the track from a starting position outside the trailer completely through the trailer then back to the starting position. For powering each such cab, the cab carries a motor drivingly connected to a roller by means of which the cab is suspended from the track.

A battery is also provided on each cab and is connected with the motor thereon. The batteries are maintained charged by charging rails inside the trailer which become connected to the battery terminals while the cab is moving through the trailer. While the cabs are outside the trailer vehicle, the batteries thereon are disconnected from the rails, and the cabs operate solely by battery power.

The trailer vehicle is adapted for being connected in end to end relation with a like trailer vehicle and the track is adapted to be modified so that the ride extends through both of the trailers where it is desired for the ride to be of extra length.

Advantageously, the trailer vehicle is provided with swing doors in one side wall near the opposite ends thereof through which the passenger cabs enter the trailer and through which the passenger cabs leave the trailer.

The exact nature of the present invention will become more apparent upon reference to the following detailed specification taken in connection with the accompanying drawings in which.

DETAILED DESCRIPTION OF THE INVENTION

Figure 1:
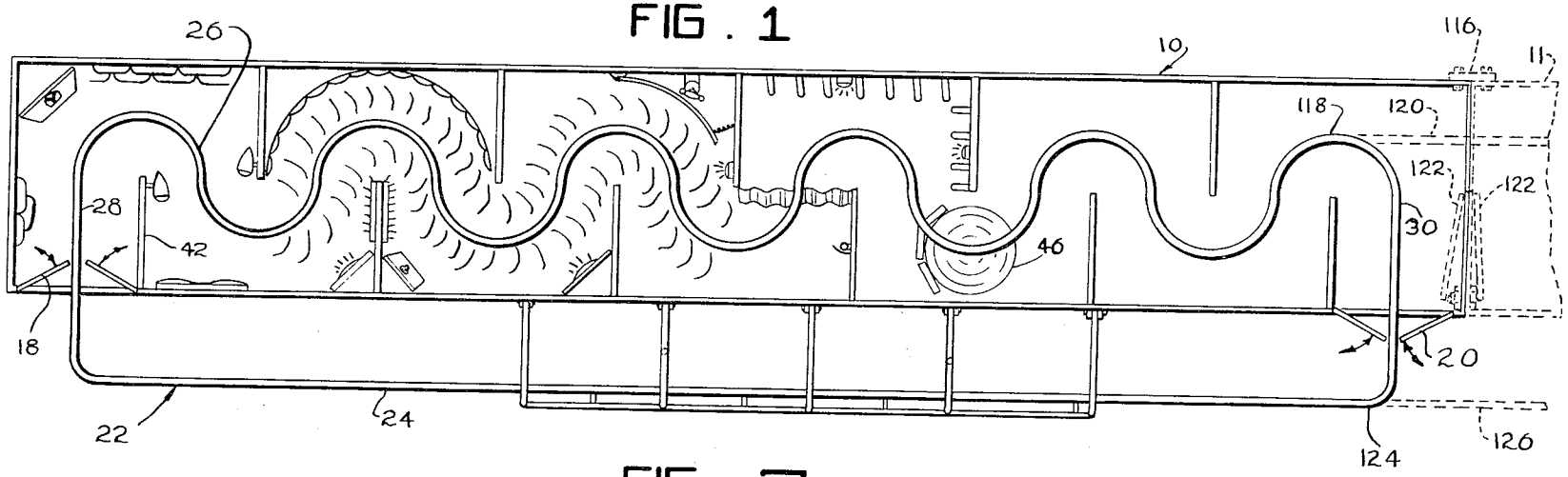
FIGS. 1, 2 and 3 show plan sectional, side and end views respectively of the ridde arrangement according to the present invention.
Figure 2:
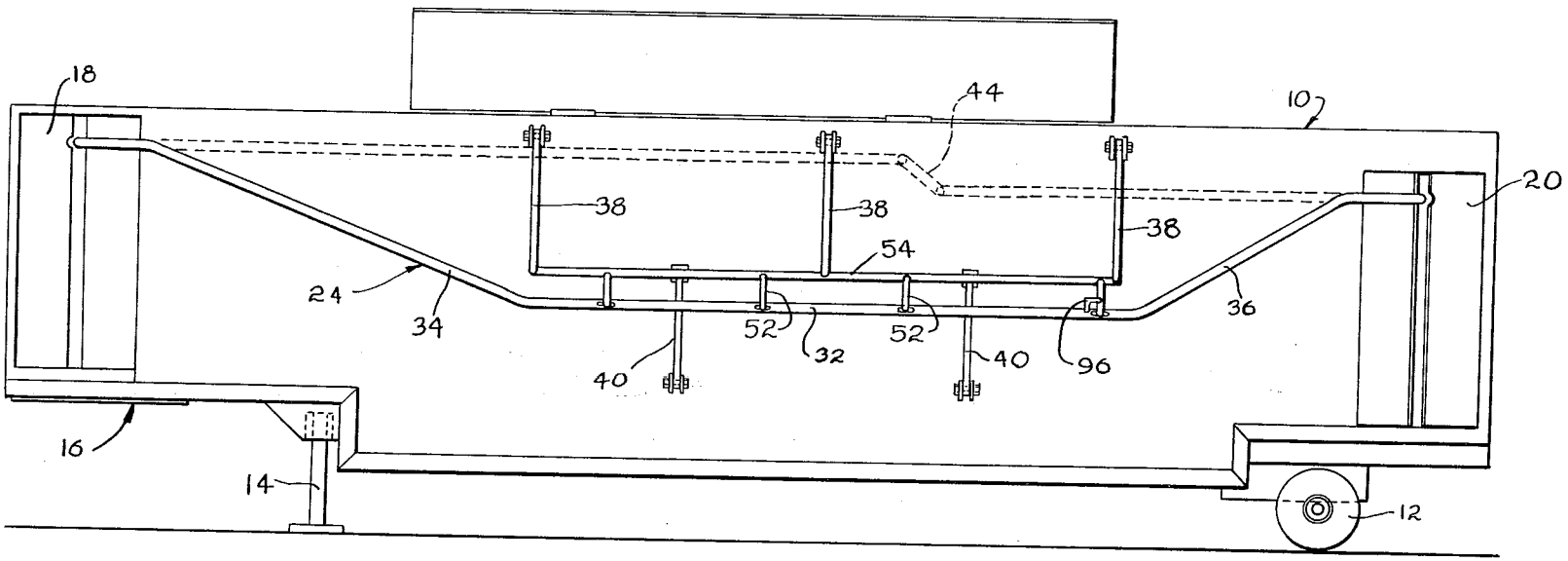
Figure 3:
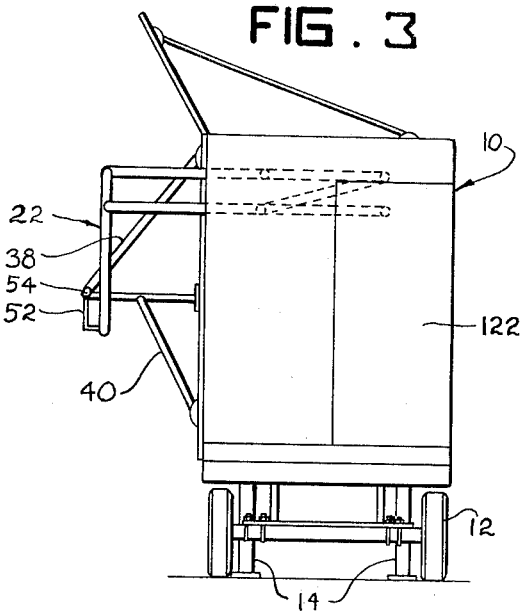

Referring to the drawings somewhat more in detail, FIGS. 1, 2 and 3 show a trailer vehicle 10 which may be of substantially conventional configuration. The vehicle is provided with wheels 12 at one end and retractable jacks 14 at the other end and has means at 16 for connection thereof to a tractor for movement of the trailer vehicle.

The body portion of the vehicle has inwardly opening swinging doors 18 at one end and outwardly opening swinging doors 20 at the opposite end. A track generally indicated at 22 is provided having one reach 24 outside the trailer, while inside the trailer is a second reach 26 which, as will be seen in FIG. 1, follows a sinuous path through the trailer while end sections 28 and 30 connect the aforementioned reaches.

The reach 24, as will be seen in FIG. 2, comprises a horizontally extending lower portion 32 forming a loading and unloading zone and portions 34 and 36 at opposite ends thereof which incline upwardly away from portion 32.

The outer reach 24 of the track is detachably connected to the outside of the trailer as by hanger means 38 and may be braced by brace members 40. Hangers 38 and brace members 40 are detachable and the end sections 28 and 30 of the track include separable joints so that the part of the track on the outside of the trailer can be removed therefrom and stowed inside the trailer for transport.

As will be seen in FIG. 1, the inside of the trailer includes a plurality of lateral partition members 42 which effectively divide the length of the trailer into a plurality of compartments. These compartments may contain devices for creating special effects such as loud speakers, curtains, blowers, special lighting arrangements and the like according to practices known in the art. At one point along reach 26 of the track, there is a relatively abrupt drop 44 which may be positioned immediately ahead of a basin or kettle member 46 containing a liquid simulating hot water, or the like.

Figure 4:
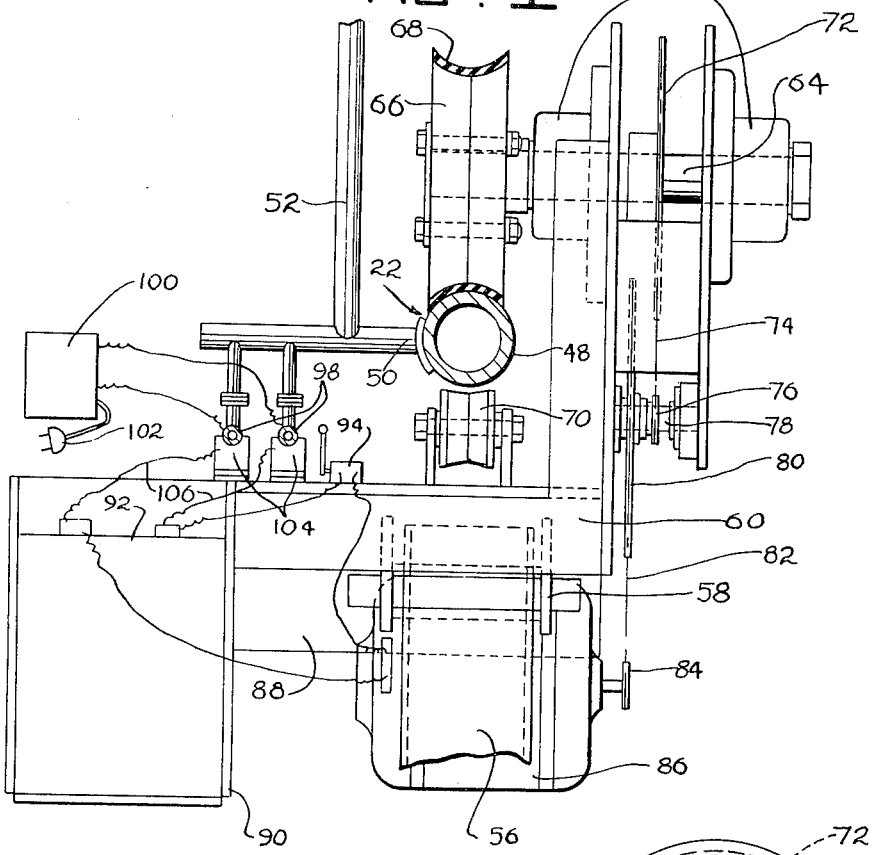
FIG. 4 is a view showing a typical support trolley from which a passenger cab is suspended.

As will be seen in FIG. 4, the track which has generally been referred to by reference numeral 22 comprises a tubular rail 48 and fixed thereto and extending laterally from the rail are support elements 50 which may be distributed along the rail as may be required to provide proper support therefor.

Each support element 50 has fixed thereto a hanger element 52 which is advantageously connected to a stationary support structure near or at the top of the trailer on the inside of the trailer while outside the trailer the hanger elements 52 are connected to a rail member 54 which, in turn, is connected to the hanger members 38 and the brace members 40. In the described manner, the tubular rail 48 forming the main portion of the track is exposed toward the top and the bottom and one side throughout the length of the track.

The passenger cabs, or compartments, have a vertical hanger post 56 extending upwardly therefrom and pivotally suspended from the support elements 58 which are welded to the underside of an angular bracket 60. Bracket 60 has a horizontal portion extending laterally beneath rail 48 and a vertical portion extending vertically along the open side of rail 48. Near the upper end of the vertical portion of bracket 60 there are provided bearings 62 in which a shaft 64 is rotatably mounted.

On the end of the shaft over rail 48, there is a concave wheel 66 which is advantageously provided with a rubber-like covering 68. The wheel 66 forms the support for the passenger cab and the structure of each passenger cab and the mechanism mounted on bracket 60 is substantially balanced with regard to a vertical center line passing through rail 48.

Each bracket is captive on rail 48 by means of a roller 70 carried by the bracket and disposed closely beneath rail 48.

The aforementioned shaft 64 has a larger sprocket 72 thereon connected by roller chain 74 with a smaller sprocket 76 which is fixed to a shaft 78 together with another larger sprocket 80. Larger sprocket 80 is connected by a further roller chain 82 with a smaller sprocket 84 on the output shaft of an electric motor 86 suspended from an inclined bracket plate 88 dependent from the underside of bracket 60.

The bracket 60 also supports a battery compartment 90 which contains a battery 92 that is connected in circuit with motor 86 via an on-off switch 94. When the switch is closed, the battery causes the motor to rotate and the passenger cab will be propelled along track 22 in the clockwise direction as it is viewed in FIG. 1.

As each passenger cab rolls down incline 36 of the track appproaching the loading and unloading section, a trip element 96 will engage the actuating lever of switch 94 and open the switch, thus, interrupting the supply of power to the respective motor 86 and permitting the respective cab to come to a halt along region 32 of the track which forms the loading and unloading region. Each cab motor can be energized by the ride attendant by manually moving the respective on-off switch to closed, or "ON" position.

Inside the trailer are charging rails 98 insulatingly supported on support elements 50 and connected to a battery charger 100 which is energized by a cable 102 as from any suitable source of alternating current.

The bracket 60, on the other hand, has insulatingly and tiltably mounted thereon a pair of sliders 104 which engage rails 98. These sliders are connected to the terminals of the respective battery 92 by wires 106 so that as each passenger cab progresses along the reach 26 of the track inside the trailer the respective battery will be charged while outside the trailer the cabs run on battery power alone. This permits the use of relatively small batteries and, at the same time, creates absolutely safe conditions in all parts of the ride because no high voltages are encountered any place within the ride arrangement.

Figure 6:
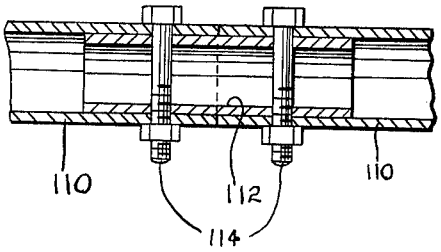
FIG. 6 is a fragmentary sectional view showing how joints could be formed at any desired place along the track of the ride.
Figure 7:
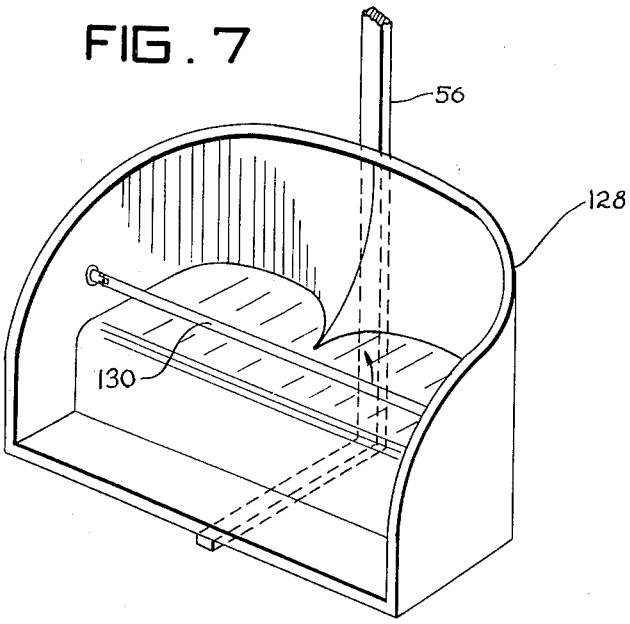
FIG. 7 is a rather schematic view showing one form which a passenger cab could take.

It has been mentioned that the track 22 can have separable connections therein and one such connection is illustrated in FIG. 6 wherein track sections 110 are arranged in abutting relation with a sleeve 112 telescopically engaging the sections on the inside and with bolts 114 being provided to connect the sections and the sleeve together.

These joints could be provided in as many places as desired so that the track could be broken down into as many parts as might be necessary for transporting, for example, the part of the track on the outside of the trailer. The bolts 114 extend horizontally through the rail sections 110 and do not interfere with the movement of the cabs along the track.

As illustrated in FIG. 1, vehicle 10 can be placed in end to end relation with a like trailer vehicle 11 and connected thereto by suitable connecting means as indicated at 116. The reach 26 of the track in vehicle 10 could then be separated at point 118, utilizing separable connector means as illustrated in FIG. 6, and the track extended longitudinally as indicated at 120 for connection with a track provided in vehicle 11. Each of the vehicles has a suitable door 122 in the end wall to provide communication between the trailers when connected in end to end relation.

Similarly, reach 24 of the track on the outside of the trailer could be separated at point 124 then extended longitudinally as at 126 to form the elongated outside reach necessary for the ride when two trailers are placed in end to end relation.

Figure 5:
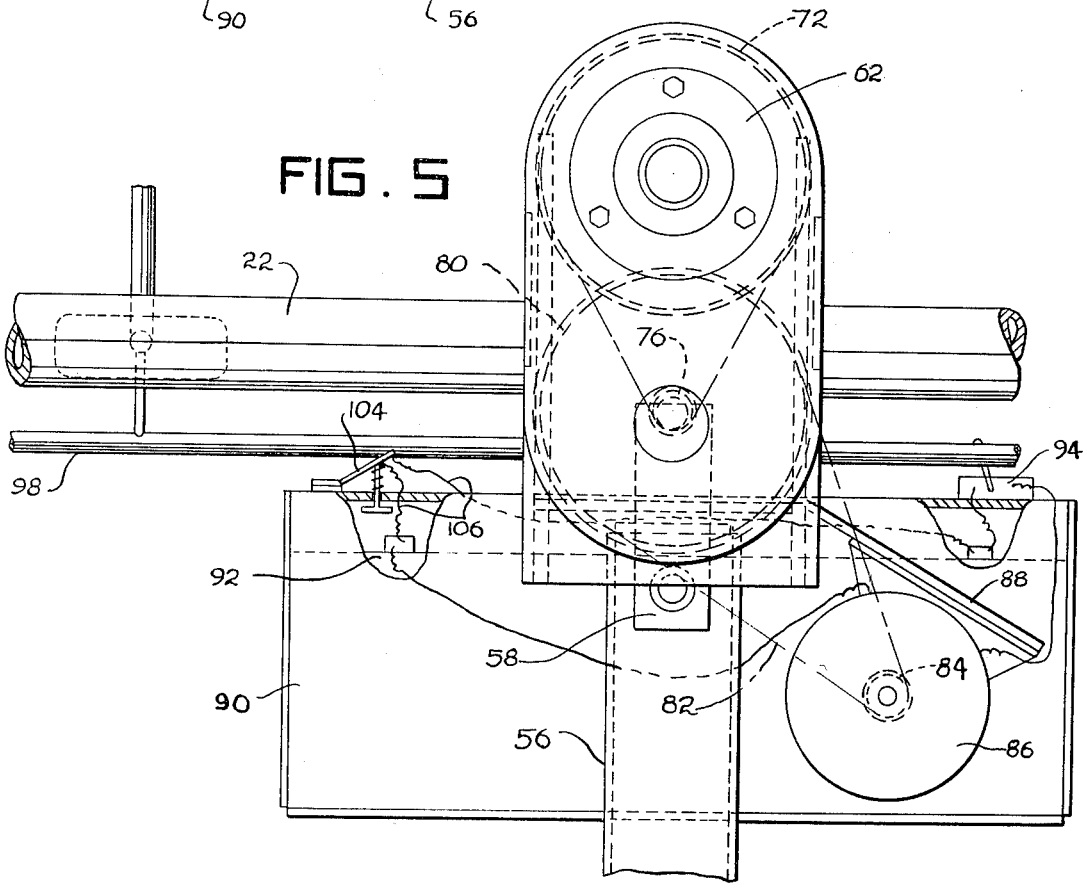
FIG. 5 is a view looking in from the right side of FIG. 4.

The cab support post or column indicated at 56 in FIGS. 4 and 5 extends downwardly and a suitable seat arrangement 128 is connected to the lower end thereof. This seat arrangement may provide space for two passengers and advantageously includes a tiltable lock bar 130 for safety purposes.

Modifications may be made within the scope of the ammended claims.

What is claimed is:

1. In an amusement ride device; enclosed trailer vehicle means, endless track means comprising a first reach extending longitudinally through the trailer means and a second reach extending outside the trailer means, and end sections joining said reaches, passenger cabs supported by said track means, and a motor on each of said cabs for propelling the cabs along said track means, said trailer vehicle means comprising a pair of trailer vehicles in end to end abutment, communicating door means in the abutting ends of said vehicles, said first reach of said track means extending through both of said vehicles and including separable connector means in the region of abutment of the vehicles, said second reach of said track means extending along the outside of said vehicles, said end sections of said track means being adjacent the ends of the vehicles which are remote from one another.

2. An amusement ride device according to claim 1 in which at least said first reach of said track means follows a sinuous path inside at least one of said vehicles.

3. An amusement ride device according to claim 1 in which said end sections of said track means include separable coupling means and said second reach of said track means is detachably supported on the vehicles to facilitate partial disassembly of the device for transport.

4. An amusement ride device according to claim 1 in which said first reach of said track means follows a sinuous path inside said vehicles and includes at least one relatively abrupt decline thereon.

5. An amusement ride device according to claim 1 in which each motor is a battery powered electric motor, a battery on each cab, circuit means for each cab including an on-off switch connecting the battery on the cab with the motor thereon, a battery charger, and connector means operable while said cabs are within a predetermined range along said track for electrically connecting the said batteries thereon with said battery charger.

6. An amusement ride device according to claim 5 in which said connector means comprises rail means in at least one of said vehicles electrically connected to said battery charger, and slider means on each cab electrically connected to the respective battery and engageable with said rail means during movement of the cabs along said first reach of said track means.

7. An amusement ride device according to claim 5 which includes a support and drive roller for each cab engaging said track means from above, bracket means supporting said roller and dependent therefrom and extending laterally beneath the track means, each cab being swingably suspended from the respective bracket, each bracket supporting the respective electric motor and the battery therefor, and drive means connecting each motor to the respective roller.

8. An amusement ride device according to claim 5 in which said second reach of said track means includes a longitudinal loading region for the loading and unloading of passengers, and means near the entrance end of said region for turning each said on-off switch to the "OFF" position thereof as the respective cab enters the said region.

9. An amusement ride device according to claim 8 in which said loading region is at a lower elevation than the remainder of said track means.

* * * * *